US007414531B2

(12) United States Patent
Davies

(10) Patent No.: US 7,414,531 B2
(45) Date of Patent: Aug. 19, 2008

(54) THEFT DETERRENT SYSTEM

(75) Inventor: Nicholas C Davies, Tickenham (GB)

(73) Assignee: Nicholas Charles Davies, Tickenham (GB)

( * ) Notice: Subject to any disclaimer, the term of this patent is extended or adjusted under 35 U.S.C. 154(b) by 153 days.

(21) Appl. No.: 11/204,371

(22) Filed: Aug. 15, 2005

(65) Prior Publication Data

US 2006/0017569 A1 Jan. 26, 2006

Related U.S. Application Data

(63) Continuation-in-part of application No. PCT/GB2005/000433, filed on Feb. 9, 2005.

(30) Foreign Application Priority Data

Feb. 10, 2004 (GB) ..... 0402900.5

(51) Int. Cl.
*G08B 13/14* (2006.01)

(52) U.S. Cl. ..... 340/572.1; 340/568.1; 340/571; 340/572.8; 235/375

(58) Field of Classification Search ..... 340/572.1, 340/568.1, 571, 572.3, 572.4, 572.8; 705/16, 705/18; 235/375
See application file for complete search history.

(56) References Cited

U.S. PATENT DOCUMENTS

| | | | | |
|---|---|---|---|---|
| 4,558,318 | A * | 12/1985 | Katz et al. | 340/5.86 |
| 5,360,628 | A | 11/1994 | Butland | 427/7 |
| 5,768,384 | A * | 6/1998 | Berson | 705/50 |
| 6,409,082 | B1 * | 6/2002 | Davis et al. | 235/385 |
| 6,547,137 | B1 * | 4/2003 | Begelfer et al. | 235/385 |
| RE38,702 | E * | 2/2005 | Clement et al. | 340/572.4 |
| 2002/0160786 | A1 | 10/2002 | Rietzler et al. | 455/455 |
| 2003/0127846 | A1 | 7/2003 | Laurie | 283/72 |
| 2006/0212357 | A1 * | 9/2006 | White et al. | 705/18 |

FOREIGN PATENT DOCUMENTS

| | | |
|---|---|---|
| EP | 1 310 890 | 5/2003 |
| FR | 2783077 | 3/2000 |
| GB | 2 116 908 | 10/1983 |
| GB | 2 330 347 | 4/1999 |
| JP | 10222071 | 9/1998 |
| WO | WO94/16902 | 8/1994 |
| WO | WO01/43110 | 6/2001 |

OTHER PUBLICATIONS

Langefels, Nicholas A. letter, Jun. 5, 2006.
Warner, Richard W. letter, Jun. 23, 2006.
Langefels Nicholas letter, Jul. 13, 2006 (attachments (a) samples (1 page) and (b) brochure (2 pages).
Warner, Richard W., letter Jul. 27, 2006.

* cited by examiner

*Primary Examiner*—Toan N Pham
(74) *Attorney, Agent, or Firm*—Harness, Dickey & Pierce, P.L.C.

(57) ABSTRACT

A security device to be attached to a retail product, wherein the device indicates the only authorized point or channel of sale and a method for deterring the theft and resale of goods. The method can include identifying a product which is likely target for theft and resale, identifying an appropriate distinguishing device to clearly indicate the authorized point or channel of sale, and applying the distinguishing device to the product.

25 Claims, 1 Drawing Sheet

THEFT DETERRENT SYSTEM

CROSS-REFERENCE TO RELATED APPLICATIONS

This application is a continuation-in-part of International Application No. PCT/GB2005/000433, filed Feb. 9, 2005; which is a PCT International Application of United Kingdom Patent Application No. 0402900.5, filed on Feb. 10, 2004 in Great Britain. The disclosures of the above applications are incorporated herein by reference.

FIELD

The present teachings relate to theft deterrent systems and particularly, but not exclusively, relate to security devices for valuable retail goods and a method of their use.

BACKGROUND

"Illicit retail" is the forum through which stolen goods are offered for sale. There is a significant resale market for certain types of goods, and theft of these items occurs throughout the manufacture, supply and retail chains as well as at retail and wholesale stores. Attractive goods for large-scale theft and resale include valuable, branded goods, which are available, removable and disposable. These goods can be stolen and sold on in an illicit market with relative ease and with little or no chance of the goods being identified as stolen or of establishing who the lawful owners of the goods are. Consequently, bulk theft of goods for resale has come to account for a significant proportion of retail theft and theft from other commercial organizations.

Theft of retail products impacts upon the profitability of retailers and their suppliers. Consequences of retail theft include the cost of replacing stolen products, administration costs and loss of sales (through reduced in-store availability, concern over stocking high loss rate products and the satisfaction of a proportion of market demand from illicit sources).

Existing theft deterrent devices, such as Electronic Article Surveillance (EAS) tags, are applied to products late in the supply chain and are only functional within the authorized retailer's shop environment, therefore offering no protection within the supply chain. Also, once a product has been stolen, the device attached thereto ceases to have any effect and indeed can actually add credibility and value to the stolen merchandise.

Recent British Home Office reports have advocated a new approach to tackling the problem of illicit retail, entitled the "Market Reduction Approach" (M Sutton, J Schneider, S Hetherington (2001) "Tackling Theft with the Market Reduction Approach", Home Office, Crime Reduction Research Series Paper 8). The approach is based on the idea that markets for stolen goods are not just a downstream consequence of theft but are the underlying motivational force for such offending. It is desirable to reduce the saleability and resale value of stolen goods in order to reduce the rewards available to those who deal in them. It is also desirable to increase and extend the risks of capture for those who deal in stolen goods. By removing the rewards available and increasing the risks associated with dealing in stolen goods, the primary motivation for retail theft is substantially removed.

An integral figure in the process of illicit retail is the "innocent consumer". Many people simply do not think to question the provenance of cheap goods from, for example, a market stall, car boot sale or indeed an established retail outlet. Of those who do, the majority of people are willing to turn a blind eye in the face of goods sold cheaper than at primary retail outlets. Removing the excuse of consumer ignorance is key to reducing the number of people prepared to buy stolen goods, and hence to reducing the resale value and opportunity for disposal of stolen merchandise.

The other key figures in the process are the thief and the handler. Research suggests that the majority of offenders have no fear of being arrested while handling or selling stolen goods, because the perceived risks are slight with numerous "safe" outlets for the stolen property and little or no chance of the stolen property being identified. It is therefore necessary to increase the risks of buying, handling and consuming stolen goods, and to ensure that these greater risks are fully appreciated by all involved.

A similar problem to that of preventing the sale of stolen goods is the problem of preventing the resale of illegally imported goods or "Grey Imports", sometimes known as 'Parallel Trading'. The pharmaceutical industry, for example, comprises large companies that sell the same or similar products in many countries. The practice of buying goods cheaply in one country and illegally importing those goods for resale in another country, or of purchasing goods for export but not actually shipping them, is well known and is a source of considerable loss of revenue for many manufacturers and for the Government in lost taxes. It is therefore desirable to reduce the ease with which such illegally imported goods can be resold.

Another related problem faced by many retailers is that of returns fraud, for example where goods have been stolen from one store and returned to a different store or retailer. Establishing that a product is genuinely purchased from the store where it is being returned, and that it is genuinely unopened and therefore suitable for return, can pose significant difficulties. This problem is highly evident in the sale of audiovisual media, such as CDs and DVDs, which are regularly purchased, illegally copied and returned to the retailer.

In this specification, the following terms have the meanings outlined below:

A point of sale is any outlet at which a product may legitimately be sold.

A channel of sale is the route by which a product reaches the market.

The term "product" encompasses an article to be sold and/or the packaging in which it is presented.

A "call to action" includes any request, inducement, encouragement or recommendation that a specific action is taken.

SUMMARY

According to the present teachings, there is provided a security device to be applied to a product, wherein the device indicates the only authorized point or channel of sale of that product.

If there is more than one authorised point or channel of sale, the device may indicate only those authorised points or channels of sale or indicate a collective group of authorised points or channels of sale. The authorised point or channel of sale may include the authorised country of sale.

According to various embodiments the device may comprise a label or tag, which specifies the only authorized point or channel of sale. The product to which the device is applied may be a retail product. The device may be attached to the product or to the product packaging and the device may be attached permanently. The packaging may comprise a transparent wrapping of polymeric material. The packaging may include a strip by which the packaging may be removed and that strip may be a tear strip. The device may be applied to or incorporated within the strip.

The device may be applied to the product packaging by etching, which may be laser etching for example by means of a $CO_2$ Scanning Laser. Laser etching is particularly suited to use on plastic packaging, for example PET and PVC based packaging, due to the permanence of the application. The device may be sprayed, embossed, machined, hot foiled, etched or printed onto the product or packaging or formed integrally with the product or packaging. The device may be attached to the product or product packaging by adhesive. The surface of the product may be modified to improve adhesion of the device to the product. The surface of the product or the product packaging may also be modified, for example by pre-treating, to assist or improve application by spraying, embossing, machining, hot foiling, laser etching, or printing. For example, the product or product packaging may be coated with a laser receptive coating to assist laser etching. The modification may include abrading the surface of the product or the product packaging.

The device may be semi-transparent and may be holographic.

According to various embodiments, branding or marketing text or graphics or other devices important to the product's integrity at point of sale may be placed over or under the device such that the addition of the device does not affect existing packaging or product design. The device may be such that removal of the device causes damage to the product or packaging. The device may comprise or may be incorporated into an electronic tag, which may, for example, be a radio frequency identification (RFID) tag or an Electronic Article Surveillance (EAS) tag.

The device may include a serial number, which may be unique to each device. The device thus facilitates stock tracking and suggests to a potential thief that each product that carries a device is being individually tracked from manufacture to sale. A product that can be precisely identified is less attractive to a thief due to the ease with which the product can be proven to be stolen.

According to various embodiments, there is provided a method for deterring the theft and resale of goods, the method comprising the steps of:

a) Identifying a product which is a likely target for theft and resale.

b) Identifying an appropriate distinguishing security device to clearly indicate the only authorized point or channel of sale.

c) Applying the distinguishing security device to the product or its packaging

According to various embodiments, the product is a valuable, branded product, which is a likely target for theft and resale. Branded products may include retailers' own brand products.

The step c) may be performed at the point of sale or before the product reaches the point of sale. The step c) may be performed at a retail warehouse, at a distribution centre, repackaging or value add service centre or at a third party logistics warehouse; the step c) may also be performed at the point of original product manufacture. The step c) may be performed by a distributor.

The device of step b) may be a device as described in the present specification.

The method may further comprise the step of providing a call to action for the public to report theft, illegal resale or handling of stolen goods. The call to action may be incorporated into the device and include contact details, such as a telephone number or website, for reporting of theft, illegal resale or handling of stolen goods and/or for providing information to the public relating to the security device and its use.

The method may further comprise the step of offering a reward for information relating to the theft, handling or resale of the stolen goods.

The product identified may be a retail product.

The method may further comprise the step of pre-treating, abrading or scoring a surface of a product or product packaging prior to the step c). The pre-treating may include roughening or otherwise modifying a surface of the product or product packaging prior to the step c).

The product may be placed in a container for distribution and information may be provided on the container regarding the device. For example, the information may include a statement that the contents of the container are protected by anti-theft devices.

According to various embodiments, there is provided a security device for attachment to a container, wherein the device indicates that the contents of the container are protected by a device as described in this specification.

According to various embodiments, there is provided a security device to be applied to a product, wherein the device indicates the only authorized point of sale of the product, for the purpose of preventing unauthorized sale or return of the product.

According to various embodiments, there is provided a method of deterring unauthorized sale or return of product, the method comprising the steps of:

a) identifying product which is a likely target for unauthorized sale or return, b) identifying an appropriate distinguishing device to clearly indicate the only authorized point of sale of the product, c) applying the distinguishing device to the product.

According to various embodiments, there is provided a security device to be applied to products within a multipack, wherein the device indicates that the product is to be sold as part of a multipack and provides a call to action to report sale of the product other than as part of a multipack.

Further areas of applicability of the present teachings will become apparent from the detailed description provided hereinafter. It should be understood that the detailed description and various examples are intended for purposes of illustration only and are not intended to limit the scope of the teachings.

BRIEF DESCRIPTION OF THE DRAWING

For a better understanding of the present teachings, and to show more clearly how it may be carried into effect, reference will now be made, by way of example, to the accompanying drawing, in which.

DETAILED DESCRIPTION OF ILLUSTRATIVE EMBODIMENTS

Figure 1:
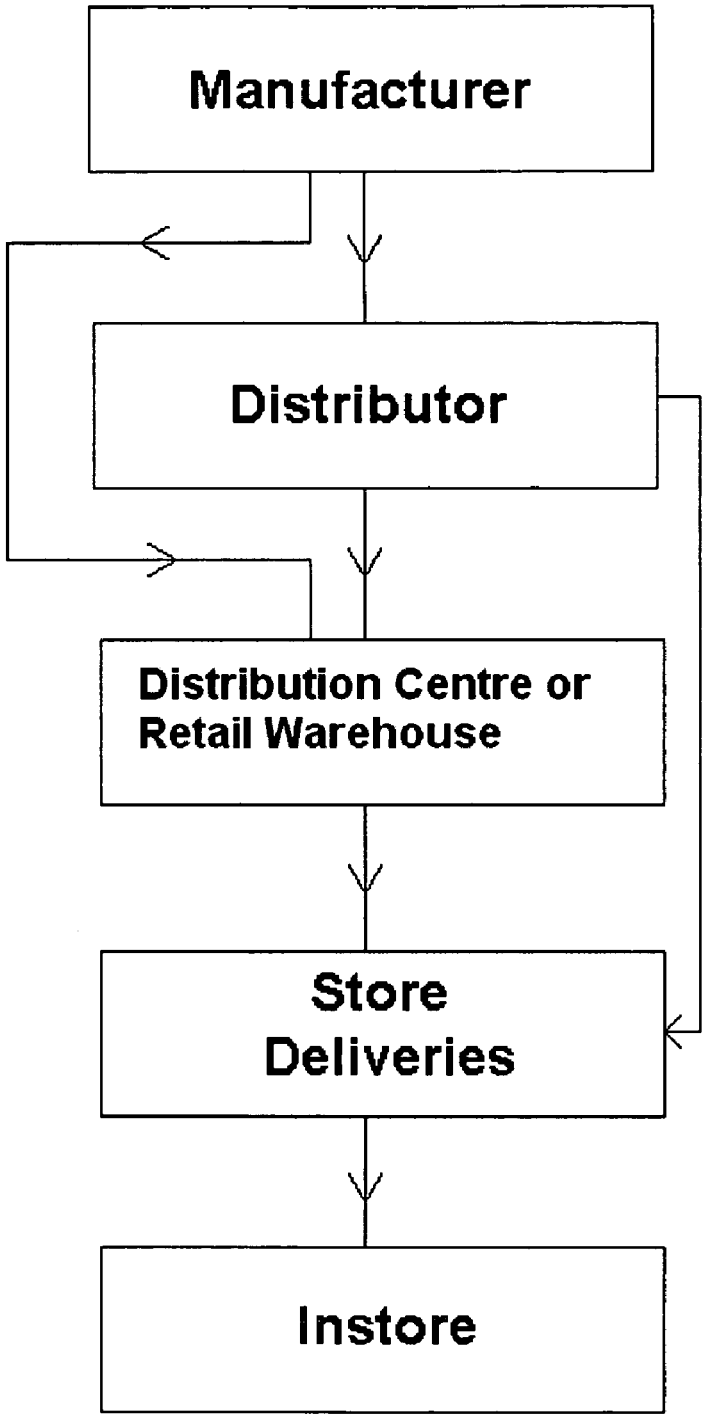
FIG. 1 is a block diagram showing the distribution chain of retail goods from manufacture to sale.

The following description of various embodiments is merely exemplary in nature and is in no way intended to limit the invention, its application, or uses.

Retail goods normally have their origin/manufacturer clearly marked on both the packaging for the product and the product itself. This marking identifies the product as genuine but does nothing to deter the theft of that product. Even when retailers use their own brand labeling, this is substantially ineffective against theft for resale because there is no call to take action against illegal sale, no reporting line service and no reward scheme. The use of own brand labeling is not a clear indication that products may only be sold from a given retailer and handlers are able to sell stolen products claiming that they are "legitimate surplus retailers' stock". Indeed, brand marking adds resale value to stolen goods and often supports the impression that the goods are being sold legally by a legitimate trader. A device according to the current application, rather than identifying the point of origin, clearly identifies the only authorized point or channel of sale, which may include the only authorized country of sale. If a product is clearly marked with its intended point of sale, illegal or unauthorized trading of that product becomes much more difficult to carry out and the detection and prosecution of offenders becomes much easier. Stolen or illegally imported goods are immediately identifiable as such to the receiver, the "innocent" consumer and the authorities. The chances of successful prosecution for receiving or handling stolen or illegally imported goods are also much increased by the ability to immediately identify such goods and to prove that they have been removed from their intended point of sale. Even if the device has been removed, the fact that the packaging has been damaged in a consistent way will provide strong circumstantial evidence to support a prosecution.

According to various embodiments, the device is a label, which is attached by adhesive or hoffoiled to the packaging of a product. The label may also be bonded, etched or printed onto the product or its packaging. According to various embodiments, the device is a design that is laser etched onto the packaging of a product. Great care is taken by brand owners to design the packaging of a product. Space is often limited and there is concern that additional security devices may obscure the brand or consumer information. A label according to various embodiments may therefore be semi transparent, and/or may be a holographic device. The label can be placed over a section of marketing text or graphics without obscuring the text or graphics, allowing the overall design of the packaging to remain unchanged. The label can also be fixed over other areas of the packaging that are important to the integrity of the packaging when selling the product. For example the label can be placed over important information or a barcode. The appearance of the label used in this manner does not detract from the aesthetic appearance or functionality of the original branding. The permanent fixing of the label to the packaging ensures that any attempt to remove the label results in damage to the packaging and a consequent reduction in the resaleability and resale value of the product. Products with damaged or missing packaging have to be sold at a greatly reduced price, thereby reducing the profit available from the sale of the goods.

According to various embodiments, the device includes a serial number, which is unique to each individual device. The serial number may include letters, numerals, coded data and symbols and may be adapted for a particular manufacturer or retailer. The serial number can be used to facilitate accurate stock tracking. Should a product carrying a device be stolen, not only does the device identify the product as stolen but the serial number could enable the manufacturer, retailer or distributor to determine at what point in the supply and distribution chain the product was stolen and from where. Even if such stock tracking does not take place, the presence of the serial number sends a message to a potential thief that stock tracking could be taking place. The deterrent effect is therefore still achieved.

A clear benefit of the present teachings is to reduce the resale market of stolen goods and increase the risk of capture. However, there are other benefits associated with the use of the device, particularly in the area of combating returns fraud. The device, appropriately placed, could serve as a "tamper evident" device, helping to distinguish genuinely untouched goods, suitable for return, from those which have been opened and/or tampered with. The device could also prevent goods purchased or stolen from one retailer from being returned to another, as often happens with goods purchased or stolen from supermarkets or large retail outlets.

According to various embodiments, the label is attached, or the device is etched, to cellophane wrapping placed around a product and the device may be incorporated, for example, into the tear strip or tape commonly found on such wrapping. The device may be used to indicate that returned goods will only be accepted if the cellophane and tear strip, including the label, are intact.

Various embodiments of the device can include a tag, which may comprise an electronic tag such as a Radio Frequency Identification (RFID) tag or Electronic Article Surveillance (EAS) tag. The device may be sprayed, etched, printed or embossed on to either the packaging or the product. Alternatively, the device may be formed integrally with the packaging or with the product.

The point in the distribution chain at which the security label is applied is an important consideration. Consequently, one method for the deterrence of theft and resale of goods includes the steps of:

a) Identifying valuable, branded goods, which are a likely target for theft and resale and are easily disposable.
b) Identifying the security device disclosed above as an appropriate distinguishing device to clearly indicate the only authorized point or channel of sale.
c) Applying the security device to the goods at the point of original product manufacture or as early as possible in the supply chain or at the retail store.

According to various embodiments, step (a) can be replaced with, or accompanied by the step of identifying goods in which stock shrinkage has been recorded.

FIG. 1 shows a typical supply and distribution chain for a retail product. Existing anti-theft devices are typically applied at step 5, once the goods have reached the store and furthermore the devices are only functional as a shoplifting deterrent within the store. However, a significant proportion of the theft of retail goods takes place before the items reach the final point of sale. Goods are lost at every step along the chain, in manufacture, distribution, storage, and delivery. A significant proportion of theft for resale occurs between distribution and delivery, it is therefore important that the anti-theft device be applied early in the chain, allowing goods stolen throughout the distribution chain, and in store, to be identified and protected against theft for resale.

According to various embodiments, deterrence of theft and resale of goods further includes the steps of:

d) Providing a call to public action and contact details, such as a telephone number or website, on the label for information relating to reporting the theft or resale of the goods, and/or
e) Providing information to the public relating to the security label and it use, and/or
f) Offering a reward for information relating to the theft or resale of stolen goods, and/or
g) Indicating on the product the countries in which sale of the product is legitimate and/or the countries in which sale of the product is not legitimate.

Publicizing the introduction of the security device to both those employed in the retail supply chain and the general public is an important part of ensuring its success. Those involved with the theft and resale of goods must perceive the risks associated with their activities to have increased. The public may also need to be made aware of the existence of the label and its function and to be encouraged to come forward with relevant information. The causal relationship between sale of stolen goods and high retail prices needs to be highlighted, to serve as an incentive for people to help in preventing the sale of stolen goods. Also, the public can be made aware that if they purchase goods which are clearly identified as stolen, they can no longer claim to be an "innocent consumer" and are themselves committing a criminal offence.

Various embodiments of the method outlined above include the application of the device at other points during the chain, specifically during distribution, storage, delivery or in store. The method could also be applied to a wider range of goods, in addition to the specific application to valuable, branded goods.

According to various embodiments of the invention, in order to raise awareness of the security label, packing containers in which protected products are transported are marked as such. For example, packing tape is provided with indications that the contents of the container to which the tape is applied are protected with anti theft labels or devices. Information in the form of posters and other marketing media can also be used to raise awareness.

According to various embodiments, the device can indicate the only authorized point of distribution of the product. Large organizations, both within government and in the private sector, often purchase disposable supplies such as printer cartridges and batteries in vary large quantities. These supplies are stored within a designated area, which may comprise a department of the organization, and distributed from that area throughout the organization. Such disposable items, are on occasion stolen in bulk from the storage area and subsequently resold in an illicit market. The security device could combat this practice by clearly indicating the organization within which a product is to be distributed, or the point from which the product is to be distributed.

The description of the teachings is merely exemplary in nature and, thus, variations that do not depart from the gist of the teachings are intended to be within the scope of the invention. Such variations are not to be regarded as a departure from the spirit and scope of the teachings.

What is claimed is:

1. An apparatus comprising:

a first security device to be applied to a product, wherein the first security device indicates the only authorized point of sale of the product, for the purpose of preventing unauthorized sale or return of the product; and a second security device for attachment to a container, wherein the second security device indicates that the contents of the container are protected by the first security device.

2. The apparatus as claimed in claim 1, wherein the authorized point of sale includes the authorized country of sale.

3. The apparatus as claimed in claim 1, wherein there is more than one authorized point of sale and the first security device indicates only those authorized points of sale.

4. The apparatus as claimed in claim 1, wherein the first security device includes a call to action to report theft or illicit resale of goods.

5. The apparatus as claimed in claim 1, wherein the first security device includes an offer of a reward.

6. The apparatus as claimed in claim 1, wherein the first security device comprises a label or tag.

7. The apparatus as claimed in claim 6, wherein the tag comprises an electronic tag.

8. The apparatus as claimed in claim 1, wherein the product is a retail or wholesale product.

9. The apparatus as claimed in claim 1, wherein the first security device is applied to the product packaging.

10. The apparatus as claimed in claim 9, wherein the packaging comprises a transparent wrapping of polymeric material.

11. The apparatus as claimed in claim 9, wherein the packaging includes a strip by which the packaging may be removed.

12. The apparatus as claimed in claim 11, wherein the strip is a tear strip.

13. The apparatus as claimed in claim 11, wherein the first security device is applied to the product packaging by etching.

14. The apparatus as claimed in claim 1, wherein the first security device is applied to the product directly.

15. The apparatus as claimed in claim 1, wherein the first security device is attached to the product by adhesive.

16. The apparatus as claimed in claim 1, wherein the first security device is sprayed on to the product.

17. The apparatus as claimed in claim 1, wherein the first security device is printed on to the product.

18. The apparatus as claimed in claim 1, wherein the first security device is applied to the product by a hot foil process.

19. The apparatus as claimed in claim 1, wherein the first security device is embossed on the product.

20. The apparatus as claimed in claim 1, wherein the first security device is semi-transparent.

21. The apparatus as claimed in claim 1, wherein the first security device is holographic.

22. The apparatus as claimed in claim 1, wherein the first security device includes a serial number.

23. The apparatus as claimed in claim 22, wherein the serial number is a coded serial number.

24. The apparatus as claimed in claim 23, wherein the serial number is a two dimensional bar code.

25. The apparatus as claimed in claim 1, wherein removal of the first security device causes damage to the product or packaging.

* * * * *

UNITED STATES PATENT AND TRADEMARK OFFICE

CERTIFICATE OF CORRECTION

PATENT NO. : 7,414,531 B2
APPLICATION NO. : 11/204371
DATED : August 19, 2008
INVENTOR(S) : Nicholas C. Davies It is certified that error appears in the above-identified patent and that said Letters Patent is hereby corrected as shown below:

In column 3, line 50; insert -- . -- after “packaging”.
In column 5, line 26; “hoffoiled” should be -- hotfoiled --.
In column 6, line 58; “it” should be -- its --.
In column 8, line 25; “claim 11” should be -- claim 9 --.

Signed and Sealed this

Sixteenth Day of December, 2008

JON W. DUDAS
*Director of the United States Patent and Trademark Office*